US008250815B2

(12) United States Patent
Siepel

(10) Patent No.: US 8,250,815 B2
(45) Date of Patent: Aug. 28, 2012

(54) WINDOW WELL COVER

(75) Inventor: Roelof J. Siepel, Earlham, IA (US)

(73) Assignee: Monarch Materials Group, Inc., Waukee, IA (US)

( * ) Notice: Subject to any disclaimer, the term of this patent is extended or adjusted under 35 U.S.C. 154(b) by 8 days.

(21) Appl. No.: 13/005,015

(22) Filed: Jan. 12, 2011

(65) Prior Publication Data

US 2012/0174499 A1 Jul. 12, 2012

(51) Int. Cl.

| | |
|---|---|
| ***E04B 7/18*** | (2006.01) |
| ***E04B 1/00*** | (2006.01) |
| ***E02D 29/14*** | (2006.01) |
| ***E02D 27/00*** | (2006.01) |
| ***E04F 17/06*** | (2006.01) |

(52) U.S. Cl. ..... 52/107; 52/19; 52/20; 52/169.6

(58) Field of Classification Search ..... 52/19, 20, 52/21, 107, 169.6, 73, 200, 201, 202, 11
See application file for complete search history.

(56) References Cited

U.S. PATENT DOCUMENTS

| | | | | |
|---|---|---|---|---|
| 3,048,897 | A * | 8/1962 | Slade | 52/19 |
| 3,232,014 | A * | 2/1966 | Frost | 52/107 |
| 4,888,920 | A * | 12/1989 | Marulic | 52/12 |
| 4,903,455 | A | 2/1990 | Veazey | |
| 5,201,151 | A * | 4/1993 | LeBlanc et al. | 52/20 |
| 5,339,579 | A * | 8/1994 | Woodyer et al. | 52/107 |
| 5,752,348 | A | 5/1998 | Pearson | |
| 6,581,338 | B2 * | 6/2003 | Koenig et al. | 52/107 |
| 6,810,629 | B1 * | 11/2004 | Hughes | 52/107 |
| 2008/0034673 | A1 * | 2/2008 | Tran | 52/19 |

* cited by examiner

*Primary Examiner* — Mark Wendell
*Assistant Examiner* — Ryan Kwiecinski
(74) *Attorney, Agent, or Firm* — Sturm & Fix LLP

(57) ABSTRACT

A window well cover that is universal to the extent that it will work on different sizes and shapes of window wells within a certain range for each size of window well cover produced.

3 Claims, 7 Drawing Sheets

10
11
12
13
15
16
16a
16b
16c
17
18
19
2
3
4

16
17
18
19
23

11
12
12
11
16
17
18
19
23

WINDOW WELL COVER

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates in general to a cover for a window well associated with a window of a building and more specifically concerns a window well cover that can be attached to many different sizes and shapes of window wells so that the window well can be opened for access as desired.

2. Description of the Prior Art

The use of window wells surrounding the exterior of below grade windows, such as a window in the basement wall of a building is widely known. Normally, such windows are near the upper side of the basement wall but are either partly or wholly below grade. To protect the window from backfill and other damage and to allow sunlight to be exposed to the window, it is customary for a window well to be placed around the full exterior of the window.

To comply with safety regulations concerning ingress and egress from below grade windows and to increase the amount of sunlight that is allowed therethrough, a trend has developed of providing relatively large window wells surrounding such windows. Although such enlarged construction has many advantages, it also has the disadvantages of allowing for rubbish and other materials to collect in the window well areas and in times of intense rain can serve as a collecting basin for unwanted amounts of moisture.

To lessen the above noted disadvantages, it is known in the art to provide window well covers for below grade windows and a variety of different types of embodiments of such covers have previously been utilized. For example, U.S. Pat. No. 4,903,455 issued to Veazey discloses a window well cover that includes an extruded metal frame for receiving the perimeter portions of a plastic glazing sheet to serve as a cover member for a window well. Although such window well structure appears to provide a relatively lightweight cover apparatus for a window well, the specific structure it employs appears to be unnecessarily complicated and relatively expensive to manufacture. The present invention provides an improved structure for a window well cover apparatus that is more universal in fitting different sizes and shapes of window wells and avoids the foregoing disadvantages of prior art window well covers.

BRIEF SUMMARY OF THE INVENTION

The present invention relates to a window well cover that is universal to the extent that it will work on different sizes and shapes of window wells within a certain range for each size of window well cover produced.

Many buildings, such as single family dwellings, have at least one wall portion thereof below the top grade of the ground surrounding the building, such as in a basement. These buildings often have a window disposed in the at least one wall portion for allowing light to shine into the basement and to allow egress in the case of an emergency such a fire. In that case, a window well is disposed at least partially below grade adjacent the outside of the window, the window well comprising a substantial vertical wall extending from the left side of the window to the right side of the window, an intermediate portion of the wall being spaced from the window to form a space to allow egress in case of emergency. In most cases the wall almost always has a substantially continuous enlarged upper lip.

The present invention relates to a window well cover detachable to the upper lip of the aforementioned window well. The window well cover includes a frame with a plurality of spring clips attached to the frame, each of the spring clips having an inner and an outer downwardly extending flange biased towards each other, the inner flange being in abutment with the inner side of the enlarged upper flange of the window well and the outer flange being in abutment with the outer side of the enlarged upper lip of the window well. Each spring clip is pivotally attached to a bracket about a first substantial vertical axis for permitting alignment of the inner and outer flange with respect to the enlarged upper lip of the window well wall. Also, the bracket is pivotally attached to the frame about a second substantial vertical axis to allow the clip to be adjusted with respect to the frame. By using this structure, the window well cover can be used on various sizes and shapes of window well covers within a certain range for each window well cover manufactured.

The design of the window well cover of the present invention is different than prior art covers that are attached to a building by attaching it to the side of the building with a hinge because: (1) There is no hinge on the back side of the cover; (2) It is not mounted to the house or building wall; (3) It is installed to the window well with clips; (4) The installation requires no tools and is very simple; (5) The cover mount adjusts, within limits, to the shape of the well and (6) The design can have a simple two inch aluminum profile.

Other objects, advantages, and novel features of the present invention will become apparent from the following detailed description of the invention when considered in conjunction with the accompanying drawings.

DETAILED DESCRIPTION OF THE INVENTION

Figures 1, 2, 3:
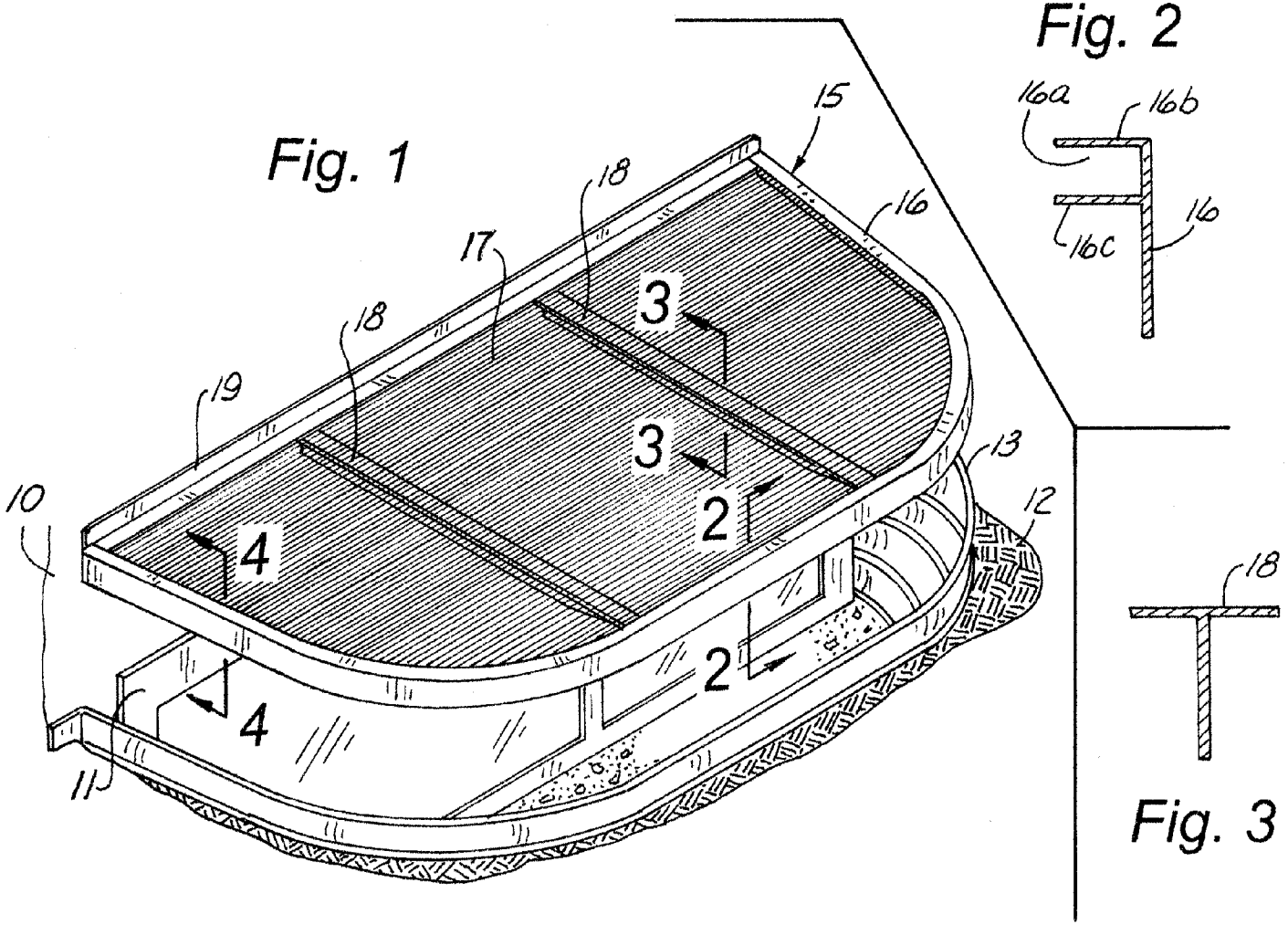
FIG. 1 is a perspective view of a building with a window below the top grade of the ground around the building, a window well between the window and the ground and a cover constructed in accordance with the present invention.
FIG. 2 is a cross sectional view taken along line 2-2 of FIG. 1.
FIG. 3 is a cross sectional view taken along line 3-3 of FIG. 1.

Referring now to the drawings wherein like reference numerals designate identical or corresponding parts throughout the several views, FIG. 1 shows a building (10) having a window (11) below the top grade (12) of the ground. A metal corrugated window well (13) extends from one side of the window (11) to the other side to form a space between the window (11) and the window well (13) to allow light to come in through the window (11) and to allow egress in case of an emergency, such as a fire in the room in which the window (11) is located.

Figure 4:
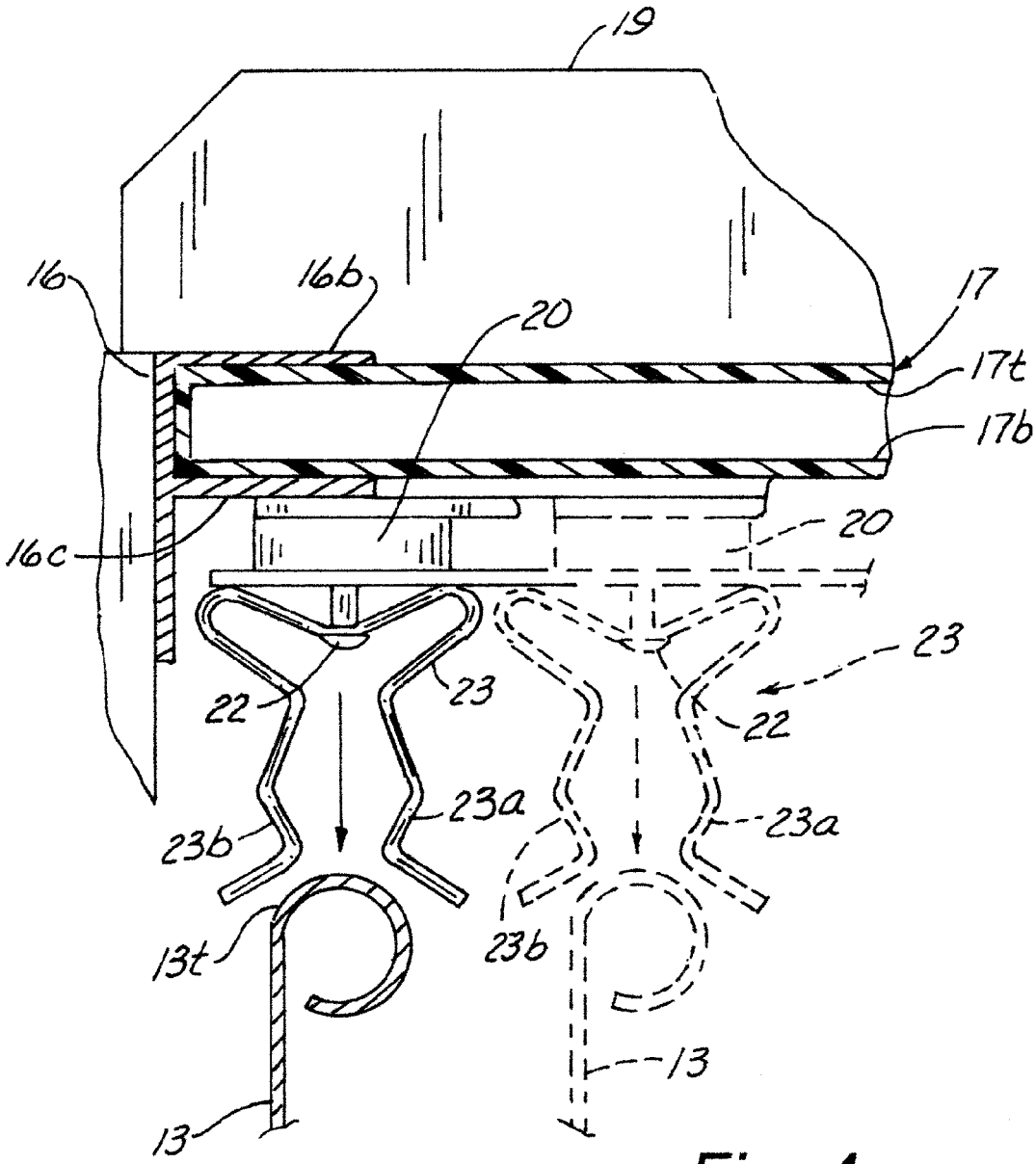
FIG. 4 is a cross sectional view taken along line 4-4 of FIG. 1 and showing how a clip can be repositioned between the solid line position and the dashed line position.
Figures 5, 6, 7, 8, 9:
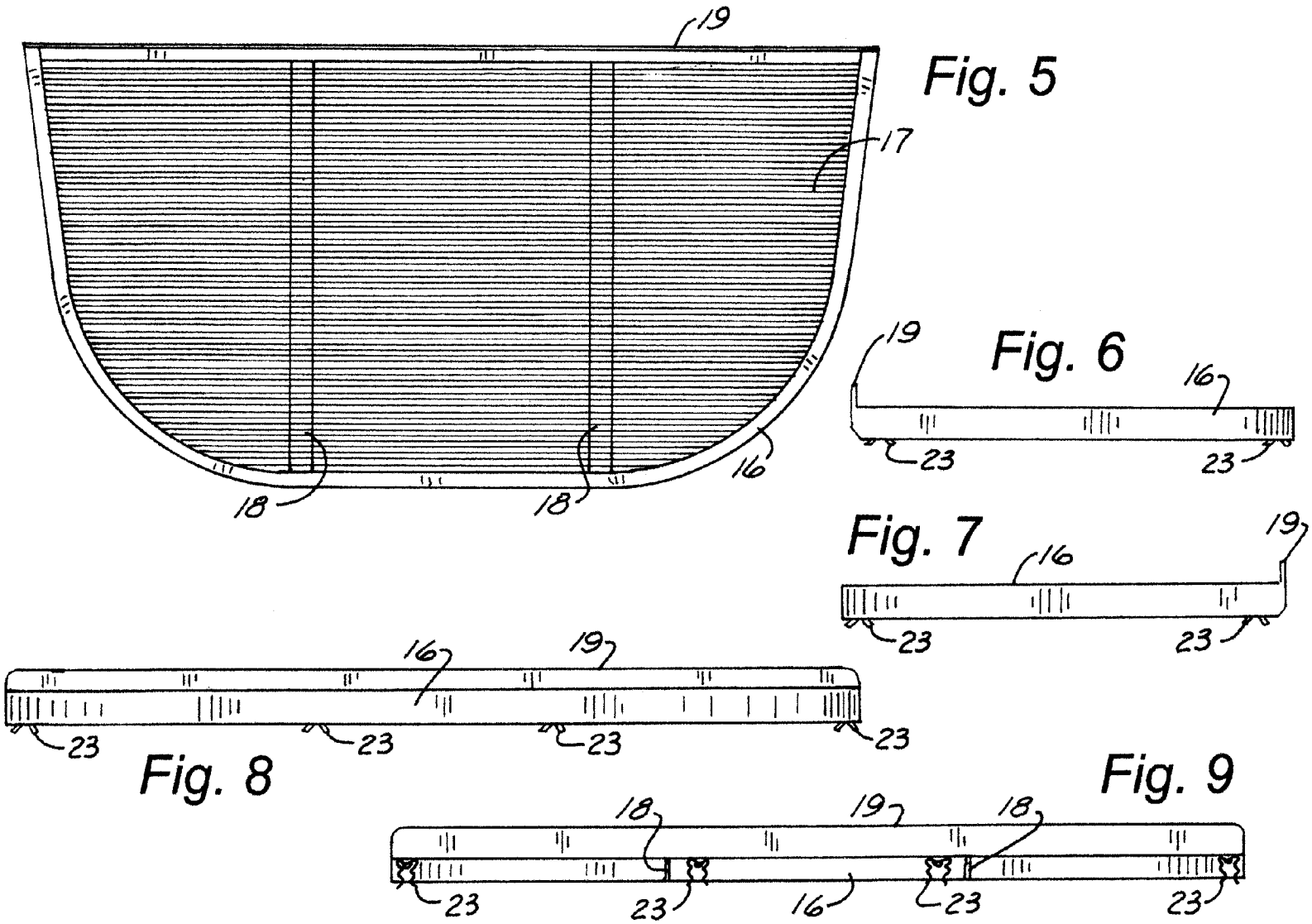
FIG. 5 is a top view of the window well cover of FIG. 1.
FIG. 6 is a left side view of the window well cover of FIG. 5.
FIG. 7 is a right side view of the window well cover of FIG. 5.
FIG. 8 is a front elevational view of the window well cover of FIG. 5.
FIG. 9 is a rear elevational view of the window well cover of FIG. 5.
Figures 10, 11, 12:
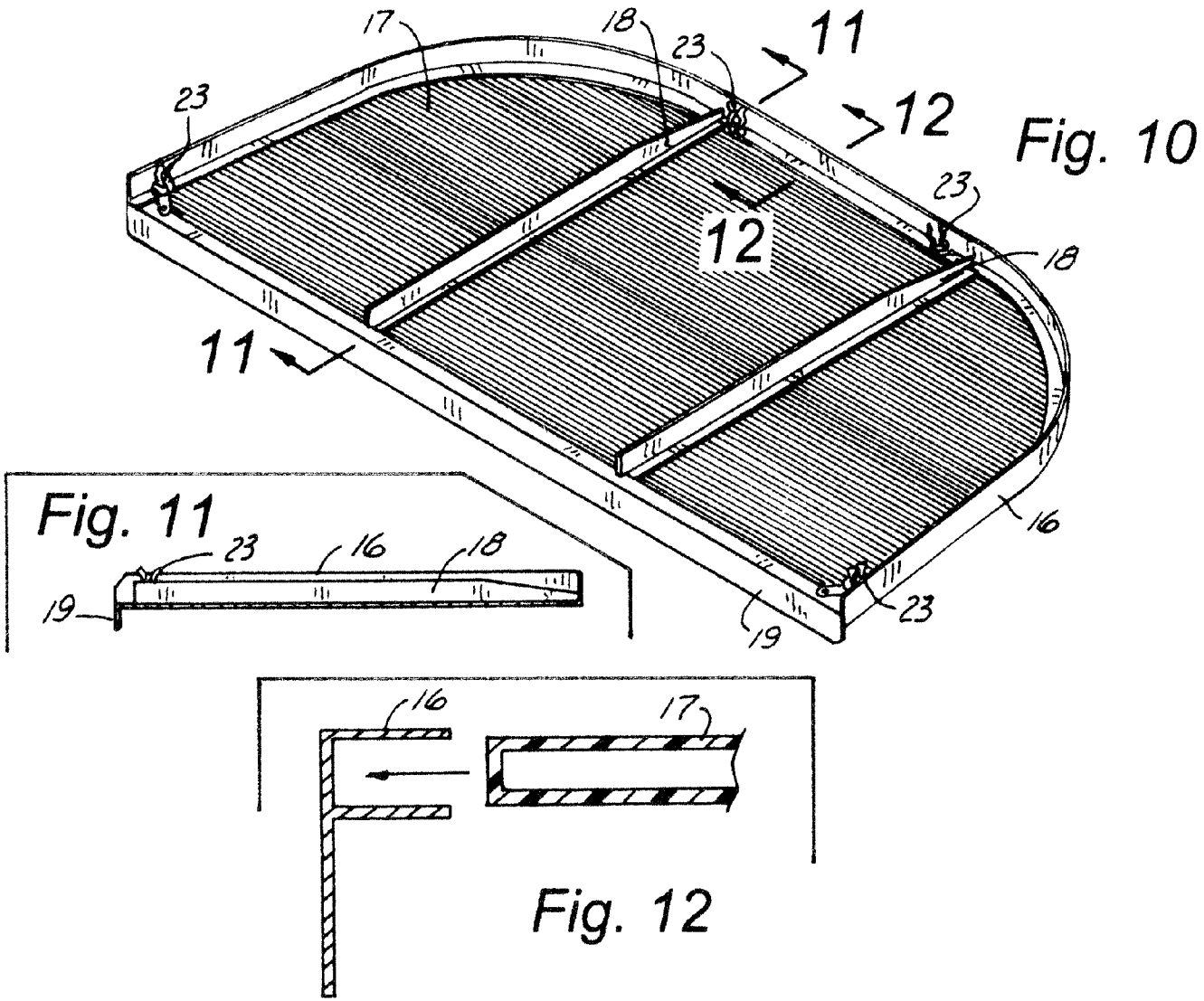
FIG. 10 is a perspective view of the bottom side of the window well cover of FIG. 5.
FIG. 11 is a cross sectional view taken along line 11-11 of FIG. 10.
FIG. 12 is an enlarged partial cross sectional view taken along line 12-12 of FIG. 10 showing how a translucent two layer sheet of polycarbonate is inserted into a slot in the frame of the window well cover during the manufacturing process.

A window well cover (15) has a frame (16) of a cross section shown in FIG. 2. A clear plastic polycarbonate member (17) is placed in the opening (16*a*) between flanges (16*b*) and (16*c*) as shown in FIGS. 2, 4 and 12. Braces (18) are placed under the layer of polycarbonate (17). The cross sectional shapes of those members (18) are shown in FIG. 3.

A flange (19) is attached to the ends of the frame (16) and to one end of each of the brace members (18). In most prior art devices, this flange (19) is attached with a hinge to the building, but no hinges are necessary in the present invention. Referring to FIG. 4, it can be seen that the two layer of poly-bicarbonate (17) with an upper layer (17*t*) and a bottom layer (17*b*) fits between the flanges (16*b*) and (16*c*) of frame member (16).

Figure 13:
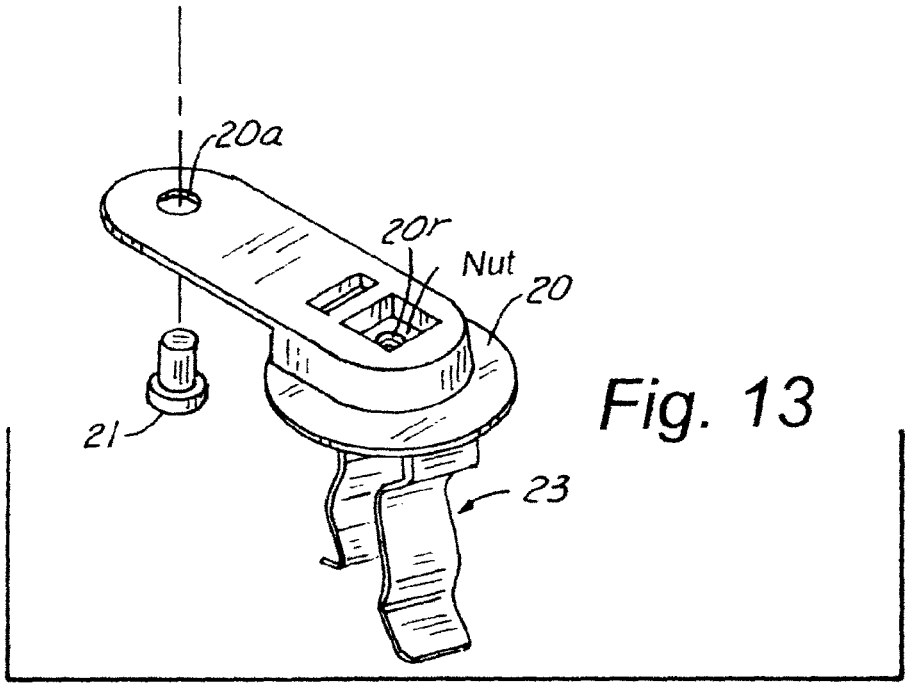
FIG. 13 is a perspective view showing how a blind rivet is used to attach the bracket and clip to the frame of the window well cover.
Figure 16:
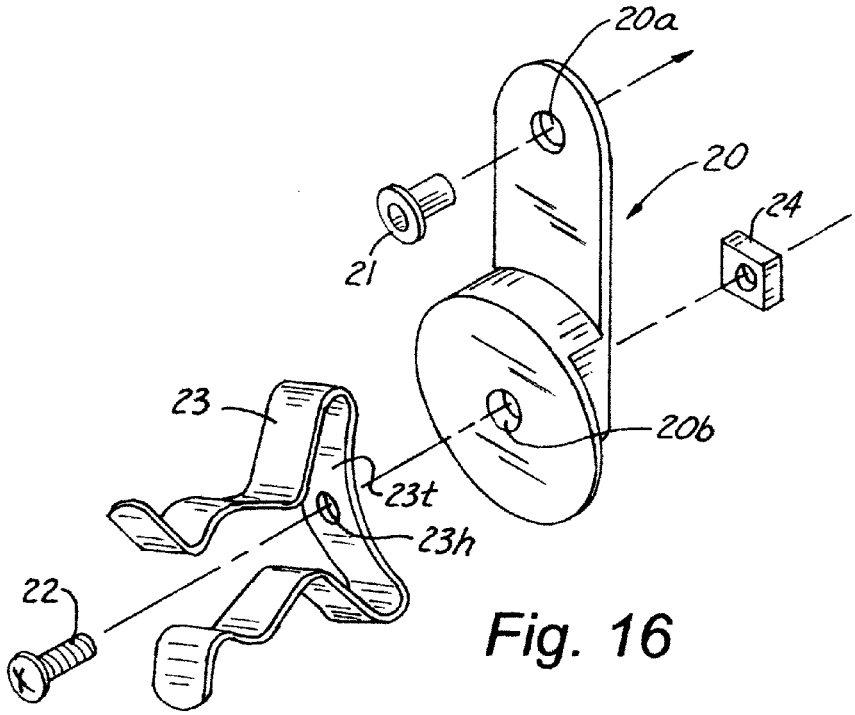
FIG. 16 is a perspective exploded view showing how a bracket is pivotally attached by a rivet to the frame and how a nut and bolt/threaded fastener attaches the clip to the bracket.
Figure 17:
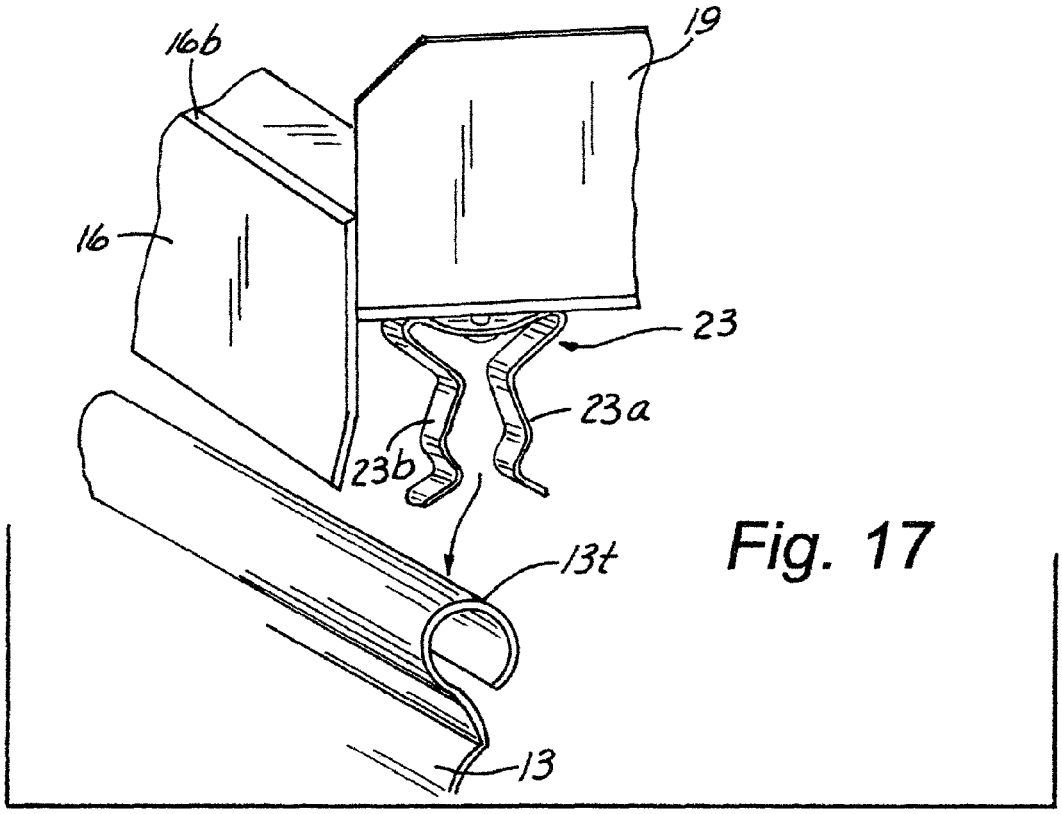
FIG. 17 is a perspective view showing how the clip attached to the window well cover can be attached to the top edge of a window well.
Figure 18:
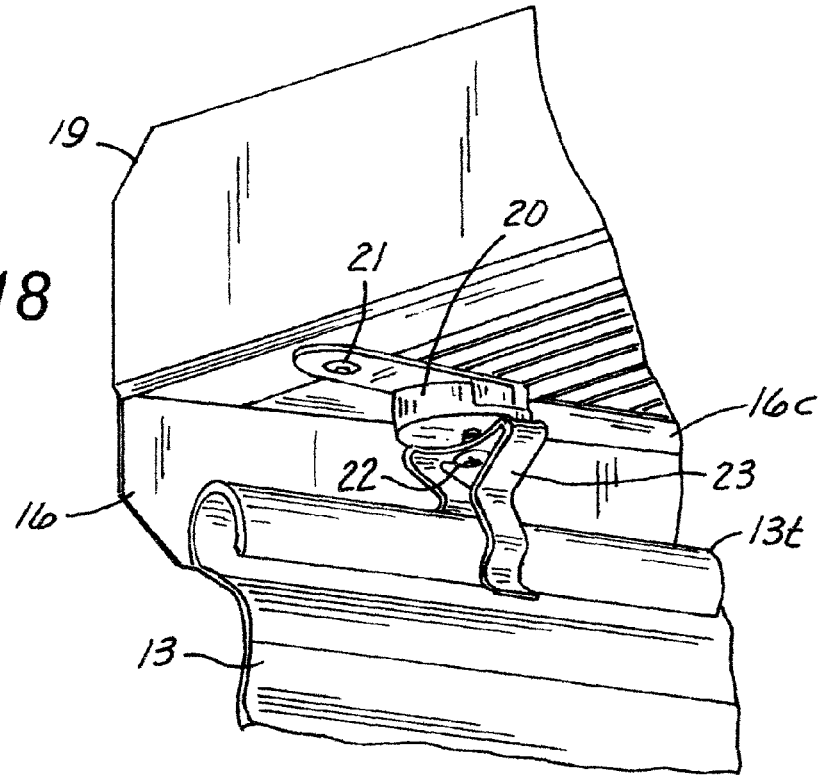
FIG. 18 is a perspective view from an underside of the window well cover showing how a bracket is pivotally attached by a rivet to the frame, how a nut and bolt/threaded fastener attaches the clip to the bracket and how the clip is attached to the upper lip of the window well.

A bracket (20) can be seen in FIGS. 4, 13 and 16. The bracket (20) is attached by a blind rivet (21) through hole (20*a*) in flange (16*c*) of the frame (16).

Still referring to FIGS. 4, 13 and 16, it is noted that a threaded fastener (22) extends through an opening (23*h*) of clip (23) and through an opening (20*b*) in bracket (20). A nut (24) is received into the enlarged recess opening (20*r*) best shown in FIG. 13 so that when the fastener (22) is tightened into the nut (24), the nut (24) will not turn due to being in the recess (20*r*).

Figure 14:
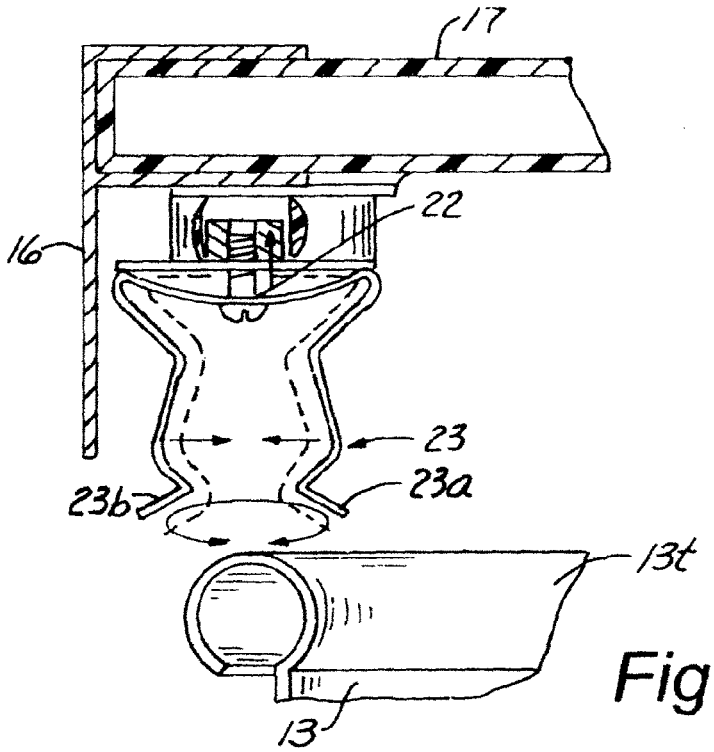
FIG. 14 is an enlarged partial cross sectional view similar to FIG. 4 and showing that if a bolt is tightened from the solid line position of the clip the sides of the clip will move in to the dashed line position, closer together.
Figure 15:
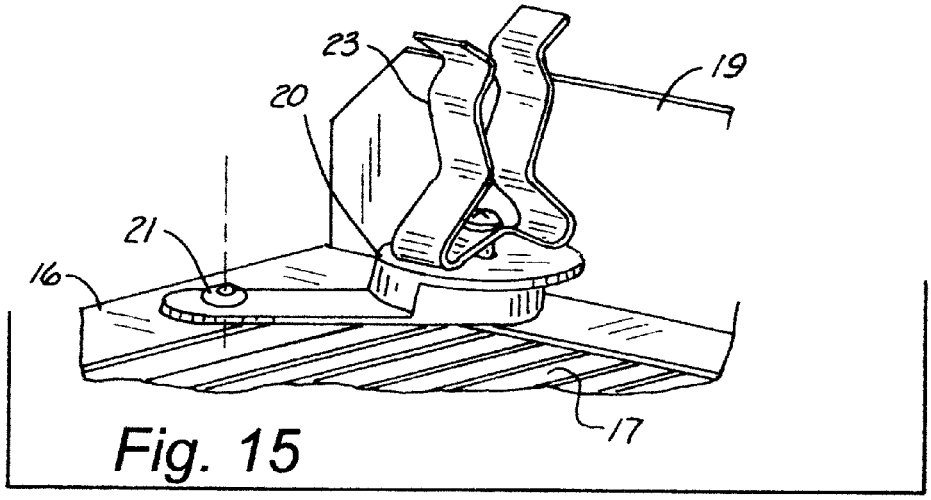
FIG. 15 is a perspective view showing how a bracket is pivotally attached by a rivet to the frame and how the bracket can pivot about the longitudinal axis of the rivet and clip can rotate about the longitudinal axis of the threaded fastener.

Referring now to FIG. 14, it is noted that when the threaded fastener is in the position shown in dashed lines and the clip (23) is shown in solid lines that the inner part (23*a*) and the outer part (23*b*) are spaced apart in order to go over the well top (13*t*). If the well top (13*t*) is smaller than that shown in FIG. 14 for example, then the threaded fastener (22) would be tightened so that an arcuate part of the top (23*t*) of clip (23) would move upwardly to the dashed line position shown in FIG. 14 thereby causing the inner clip portion (23*a*) and the outer clip portion (23*b*) to move closer together to the dashed line position shown in FIG. 14.

Having now described the structure shown in the drawings, the operation of the cover (15) will be explained. Referring to FIGS. 14-17, it is noted that if the clip (23) is not directly above the lip (13*t*) of the window well, then the bracket (20) would be pivoted around the vertical axis of the rivet (21) for example, from the position shown in solids lines in FIG. 4 to the position shown in dashed lines in FIG. 4 or anywhere in between. Then if the clip (23) is not exactly aligned about the vertical axis of the fastener (22), the clip would be rotated about that vertical axis to the position shown in FIGS. 4, 14, 17 and 18. The reason for the rotation about the axis of rivet (21) and rotation about the axis of threaded fastener (22) is that the clip (23) can be moved in or out depending on how far the top (13*t*) of the well is by rotating the clip about the axis of the rivet (21) and then depending upon the orientation of the well at that particular point the clip (23) can be rotated to accommodate that.

It will be appreciated that once the window well cover is on the window well, someone wishing to egress through the window (11) shown in FIG. 1 can merely open the window (11), push up on the window well cover (15) and it will pop up off the lip (13*t*) of the window well (13) because the clips (23) permit upward movement of the window well cover (15) by allowing the clip (23) to move off of the top of the window well (13*t*). For initial installation or after an emergency removal, the window well cover (15) can be easily replaced as explained above with respect to the initial installation thereof. Or it could be moved to a window well of a slightly different shape or configuration within certain limits.

Obviously many modifications and variations of the present invention are possible in light of the above teachings. It is therefore to be understood that, within the scope of the appended claims, the invention may be practiced otherwise than as specifically described.

The invention claimed is:

1. Apparatus for attaching a window well cover to a window well comprising:

a building having at least one wall portion thereof below a top grade of the ground;

a window disposed in the at least one wall portion below the top grade of the ground, the window having an outside and an inside, a left side and a right side;

a window well disposed at least partially below grade adjacent the outside of the window, the window well comprising a substantially vertical wall extending from the left side of the window to the right side of the window, an intermediate portion of the wall being spaced from the window to form a space to allow egress in case of emergency, the wall having a substantially continuous enlarged upper lip, the lip having an inner side closest to the window and an outer side further from the window;

a window well cover removably attached to the upper lip of the window well, the window well cover comprising:

a frame with a plurality of spring clips attached to the frame, each of the spring clips having an inner and an outer downwardly extending flange biased towards each other, the inner flange being in abutment with the inner side of the enlarged upper lip of the window well and the outer flange being in abutment with the outer side of the enlarged upper lip of the window well; and each spring clip being pivotally attached to a bracket about a first substantial vertical axis for permitting alignment of the inner and outer flange with respect to the enlarged upper lip of the window well wall and the bracket being pivotally attached to the frame about a second substantial vertical axis to allow the clip to be adjusted with respect to the frame and with respect to the enlarged upper lip of the window well, thereby being pivotally adjustable to different sizes and shapes of window wells, said second substantially vertical axis being fixed with respect to the first vertical axis.

2. The apparatus of claim 1 wherein the clip comprises spring steel.

3. The apparatus of claim 1 wherein a top portion of the clip connects the inner flange to the outer flange, said top portion of the clip being arcuate in shape, an opening disposed in a middle part of the top portion, a threaded fastener extending through the opening and being operatively attached to the bracket whereby tightening of the threaded fastener moves the middle part of the top portion of the spring clip toward the bracket causing the inner and outer flanges to be closer together and loosening of the threaded fastener permits the top portion of the spring clip to move away from the bracket causing the inner and outer flanges to move apart.

* * * * *